US009624638B2

(12) United States Patent
Lebreton et al.

(10) Patent No.: US 9,624,638 B2
(45) Date of Patent: Apr. 18, 2017

(54) MACHINE AND A METHOD FOR MAKING COLUMNS IN GROUND

(71) Applicant: SOLETANCHE FREYSSINET, Rueil Malmaison (FR)

(72) Inventors: Marie Lebreton, Rueil Malmaison (FR); Frédéric Masse, Rueil Malmaison (FR); Jean-François Mosser, Rueil Malmaison (FR)

(73) Assignee: SOLETANCHE FREYSSINET, Rueil Malmaison (FR)

( * ) Notice: Subject to any disclaimer, the term of this patent is extended or adjusted under 35 U.S.C. 154(b) by 0 days.

(21) Appl. No.: 14/868,504

(22) Filed: Sep. 29, 2015

(65) Prior Publication Data

US 2016/0097177 A1 Apr. 7, 2016

(30) Foreign Application Priority Data

Oct. 1, 2014 (FR) ..... 14 59355

(51) Int. Cl.

| | |
|---|---|
| ***E02D 15/04*** | (2006.01) |
| ***E02D 5/36*** | (2006.01) |
| ***E02D 5/38*** | (2006.01) |
| ***E02D 3/08*** | (2006.01) |
| ***E02D 3/12*** | (2006.01) |
| ***E02D 5/30*** | (2006.01) |

(Continued)

(52) U.S. Cl.

CPC ..... *E02D 5/385* (2013.01); *E02D 3/08* (2013.01); *E02D 3/126* (2013.01); *E02D 5/30* (2013.01); *E02D 5/34* (2013.01); *E02D 5/36* (2013.01); *E02D 5/665* (2013.01); *E02D 7/22* (2013.01); *E02D 15/04* (2013.01); *E02D 27/12* (2013.01)

(58) Field of Classification Search

CPC ..... E02D 5/36; E02D 5/46; E02D 15/04
USPC ..... 405/241
See application file for complete search history.

(56) References Cited

U.S. PATENT DOCUMENTS 3,512,366 A * 5/1970 Turzillo ..... E02D 5/30 405/239
3,604,214 A * 9/1971 Turzillo ..... E02D 3/106 175/323

(Continued)

FOREIGN PATENT DOCUMENTS

| | | |
|---|---|---|
| EP | 1878833 A1 | 1/2008 |
| FR | 2960571 A1 | 12/2011 |

*Primary Examiner* — Frederick L Lagman
(74) *Attorney, Agent, or Firm* — MH2 Technology Law Group, LLP

(57) ABSTRACT

The invention relates to a machine (10) for making columns in ground, the machine comprising a carrier (12) having a mast (14) extending along a longitudinal direction; a movable carriage (16) mounted to slide along the mast (14); a ground perforation tool (20) extending along a longitudinal axis parallel to said longitudinal direction and secured to said movable carriage, presenting a top end connected to building material feed means, and a bottom end provided with an orifice (28) for injecting the first building material; a rotary drive system (18) for driving the perforation tool (20) in rotation; and a body (40) extending around the perforation tool (20) so that the perforation tool is suitable for sliding through said body. According to the invention, the machine has a coupling system (60) for coupling together the body (40) and the perforation tool (20) in translation and in rotation.

18 Claims, 11 Drawing Sheets

(51) Int. Cl.

| | |
|---|---|
| ***E02D 5/34*** | (2006.01) |
| ***E02D 5/66*** | (2006.01) |
| ***E02D 7/22*** | (2006.01) |
| ***E02D 27/12*** | (2006.01) |

(56) References Cited

U.S. PATENT DOCUMENTS 3,690,109 A * 9/1972 Turzillo ..... E02D 15/04
405/241
3,886,754 A * 6/1975 Turzillo ..... E02D 7/26
405/239
4,624,606 A * 11/1986 Nakanishi ..... E02D 3/12
405/237
6,183,166 B1 * 2/2001 Schellhorn ..... E02D 5/38
405/233
7,306,405 B2 * 12/2007 Schmidmaier ..... E02D 5/36
405/241

* cited by examiner

MACHINE AND A METHOD FOR MAKING COLUMNS IN GROUND

BACKGROUND OF THE INVENTION

The present invention relates to the field of techniques for ground improvement and deep foundations.

In general manner, ground improvement techniques seek to consolidate terrains that present heterogeneous structure, in particular when they are unsuitable for building.

Such techniques include making a mesh of rigid structures in ground, commonly known as rigid inclusions. These structures are made to improve the load-bearing capacity of the ground and to reduce settlement.

More precisely, the present invention relates to a machine for making rigid structures in ground, and to a method using said machine.

The invention is particularly suitable for making such structures having low top levels.

A structure is generally said to have a low top level when the top end of a structure is several meters below the working platform.

Presently known techniques for making such structures generally provide for a continuous column to be made up to the level of the working platform and then for the column to be struck off down to the depth desired for its top level, e.g. using a mechanical digger when the material is still fresh, or by destroying it after the material has hardened (e.g. using a pneumatic drill, by splintering, or chemically).

Those various techniques involve working in a plurality of stages, thereby lengthening time to completion. They also require various different tools to be used. Striking-off when the material has hardened also presents problems associated with health and safety for operators (noise and vibration when using pneumatic drills, risk of receiving splashes with chemical methods). Striking off fresh material involves making large-sized excavations that destroy the ground and destabilize the work platform.

French patent application FR 2 960 571 in the name of the Applicant discloses a machine making it possible with a single tool and in a single stage to make a mixed-material or "hybrid" column comprising a bottom portion forming a rigid structure and a top portion made of ballast. That machine comprises a ground perforation tool and a tank arranged around the perforation tool in order to be inserted into the ground by being vibrated, either by vibrating the perforation tool to which it is coupled, or by the action of an independent vibrator. Concrete is introduced into the ground by the perforation tool over a first length that is to form the bottom portion of the column, and then ballast is poured into the ground from the tank while the tank is being raised.

Tests have shown that that machine is not suitable for making structures with low top levels, since the tank cannot be inserted to a sufficient depth in all terrains.

It has also been found that vibrating the tank has a harmful effect on the mast, since the combined vibration of the perforation tool and of the tank, acting respectively on the high and low portions of the mast weaken the machine considerably.

OBJECT AND SUMMARY OF THE INVENTION

An object of the invention is to propose a machine and a method for making rigid structures in ground, in particular structures with low top levels, and which remedy the above-mentioned drawbacks of the prior art.

This object is achieved with a machine for making columns in ground, the machine comprising:

- a carrier having a mast extending along a longitudinal direction;
- a movable carriage mounted to slide along the mast;
- a ground perforation tool extending along a longitudinal axis parallel to said longitudinal direction and secured to said movable carriage, presenting a top end connected to building material feed means, and a bottom end provided with an orifice for injecting building material;
- a rotary drive system for driving the perforation tool in rotation; and
- a body extending around the perforation tool so that the perforation tool is suitable for sliding through said body;

the machine being characterized in that it further comprises a coupling system for coupling together the body and the perforation tool, and configured in such a manner that, in at least one configuration, moving the perforation tool in rotation entrains rotation of the body and moving the perforation tool in translation entrains the body in translation.

In the present invention, it can be understood that when the body is coupled to the perforation tool, rotation is transmitted directly from the perforation tool to the body, thus making it easy to introduce the body into the ground, and that this can be done down to considerable depths, regardless of the diameter of the body.

Furthermore, since the body is constrained to move in translation with the perforation tool, there is no need to provide additional means for moving the body in the longitudinal direction of the mast. The machine thus presents a limited number of components, thereby making it simpler to assemble, and easier to use.

It can be understood that the coupling system is suitable, in a first configuration, for coupling together the perforation tool and the body to rotate about the longitudinal direction in at least one direction of rotation and to move along the longitudinal axis in translation, and in a second configuration, to uncouple said movements in rotation and translation. An example of such a coupling system that can be used is a bayonet system.

The perforation tool and the body can thus be inserted together into the ground while they are coupled together, and then they can be uncoupled so that the perforation tool can penetrate into the ground more deeply than the body, the tool sliding through the body.

The machine of the invention thus enables single tooling to be used in a single stage and accurately in order to make a column comprising a bottom portion that is made with the perforation tool and a top portion that is made with the body that is introduced into the ground.

It can be understood that the geometrical shape of the top portion of the column corresponds to the geometrical shape (imprint) of the body. In particular, the top portion of the column presents a diameter greater than the diameter of the bottom portion.

By way of example, the machine of the invention makes it possible to form "hybrid" columns having a bottom portion constituted by a first building material and a top portion that is constituted by at least one second building material that is different from the first.

Specifically, the first material is generally concrete or mortar, and the second material is generally a filler material such as ballast, granulate, sand, liquid filler, a grout, or mortar again.

The machine of the invention thus makes it possible to make rigid structures in the ground that are surmounted by a filler material that may be temporary (serving solely to plug temporarily the drill hole formed in order to make the structure and to avoid polluting the structure) or for remaining permanently in place, in particular in order to form a bed for spreading forces or to form a column head. It can be understood that the top level of the structure is then situated at the junction between the bottom portion and the top portion of the column. The depth of the top level, which corresponds to the depth of the bottom end of the body once inserted into the ground, can thus be determined accurately.

Advantageously, the machine thus has means for feeding a first building material connected to the top end of the perforation tool, and means for feeding at least one second building material, different from the first, which means are connected, by way of example, to the top end of the perforation tool or to the body.

On being driven in rotation, the body can penetrate into the ground down to a considerable depth, even when it has a large diameter. The machine of the invention is thus suitable for making structures with a low top level. It serves in particular to make such a structure using a single tool, in a single stage, and in reliable manner.

As described below, the machine of the invention also makes it possible to make single-material columns, referred to as two-diameter piles or columns, having a bottom portion, and a top portion of diameter greater than the bottom portion. Under such circumstances, the bottom portion and the top portion of the column are made using the same building material.

In a first embodiment of the invention, the body is not attached to the mast. More particularly, the body is never attached to the bottom end of the mast. It is independent of the mast. In this embodiment, it can be understood that the body is not connected directly to the mast, and nor is it connected indirectly to the mast via an intermediate device fastened to the bottom end of the mast. The body is connected to the mast solely by means of the perforation tool and the coupling system.

With such a configuration, the mast is protected from vibration forces that might damage it.

In a second embodiment of the invention, the machine further includes a second rotary drive system mounted on the mast, and configured to drive the body in rotation. The second rotary drive system serves to increase the rotary torque applied to the body, which can be advantageous or even essential, particularly when the body is to be inserted deeply into the ground.

In the first embodiment, and preferably also in the second embodiment, the means for moving the body in the longitudinal direction of the mast are formed by the perforation tool. In the second embodiment, more particularly, the second rotary drive system may, for example, be mounted on a carriage, itself mounted to move freely in translation along the mast and adapted to be driven in the longitudinal direction of the mast by the body and the perforation tool. In other words, there are no other mans for driving the body in translation along the mast, and in particular no such means mounted on the mast.

Advantageously, the rotary perforation tool is of the type comprising a central core extending along the longitudinal axis and surrounded by a helical blade, forming an auger. In an advantageous example, the perforation tool is a displacement auger that, on penetrating into the ground, compacts the ground laterally without vibration and without causing spoil to rise up the borehole.

The body generally comprises a cylindrical outer shell for coming into contact with the ground and extending around the perforation tool. It can be understood that when the body and the perforation tool are coupled together, rotation of the perforation tool is transmitted to the outer shell of the body, which then turns in contact with the ground. To facilitate this penetration into the ground, the outer shell carries a helical blade, e.g. on its outside face.

By way of example, the outer shell is in the form of a tube of substantially constant circular section.

It is sometimes desirable for the top portion of the column to present a diameter that is significantly greater than the diameter of the bottom portion of the column. This applies in particular when it is desired to make two-diameter piles.

In an example, the diameter of the outer shell is at least 1.2 times greater than the diameter of the perforation tool, and preferably at least 1.5 times greater than said diameter.

In the present application, the term "diameter" is used of the outer shell to mean its maximum outside diameter.

Likewise, the term "diameter" is used of the perforation tool to mean its maximum outside diameter.

In an example, the body further includes an inner wall arranged between the outer shell and the perforation tool.

When it is desired to make hybrid columns, the body may serve to receive a second building material, and it may be provided at its bottom end with an opening for discharging said second material.

The space defined between the outer shell and the inner wall is then for receiving the second material, before it is discharged through the opening.

In an example, the perforation tool further includes a shutter suitable for shutting the orifice.

Advantageously, said shutter is arranged in such a manner that it shuts the orifice when the bottom end of the perforation tool comes into contact with the bottom end of the body.

The invention also provides a method of making a column in ground by using a machine as defined above, the method comprising the following steps:

a) rotating the perforation tool and the body while they are coupled together in rotation and in translation to cause them to penetrate into the ground to a first predetermined depth;

b) uncoupling the body and the perforation tool;

c) lowering the perforation tool to a second predetermined depth deeper than the first depth;

d) raising the perforation tool from said second predetermined depth while injecting a first building material into the ground through the orifice situated at the bottom end of the perforation tool so as to form the bottom portion of the column; and e) raising both the perforation tool and the body.

It can thus be understood that during step a), the perforation tool is caused to move (in rotation and in translation downwards in the ground) by moving the movable carriage along the mast and by actuating the rotary drive system for the tool, this movement of the perforation tool being transmitted to the body via the coupling system.

In an implementation, the body is driven in rotation and in translation solely by the perforation tool.

In another implementation, the machine has a second rotary drive system mounted on the mast and configured to drive the body in rotation, and during step a), the body is driven in rotation by the second rotary drive system.

In an implementation, during step e), at least one second building material is discharged into the ground while raising the perforation tool and the body.

It can be understood that the second building material may be different from the first building material, or that it may be identical thereto.

When the second building material is different from the first, the body may be designed to receive the second building material and may be provided at its bottom end with an opening for discharging said second building material, such that during step e), the second material is discharged via said opening.

When the second building material is identical to the first building material, it is possible during step e), to discharge the second building material via the injection orifice of the perforation tool.

In an implementation, during step d), the perforation tool is raised up to the first predetermined depth and the body and the perforation tool are coupled together in rotation; thereafter, during step e), the assembly formed by the body and the perforation tool is raised by making them turn, and while continuing to discharge the second building material into the ground.

In an example, method may include a preliminary step a0) that is performed before step a) in order to decompress the ground if it is too compact, so as to make it easier to introduce the body into the ground. During this preliminary step, and by way of example, the perforation tool is lowered into the ground on a first occasion at least down to the first predetermined depth, and is then raised.

In an implementation, the method includes a step after step e), during which at least one reinforcement cage is introduced into the column.

BRIEF DESCRIPTION OF THE DRAWINGS

The invention can be better understood on reading the following detailed description given by way of non-limiting indication and with reference to the accompanying drawings, in which.

DETAILED DESCRIPTION OF THE INVENTION

Figure 1:
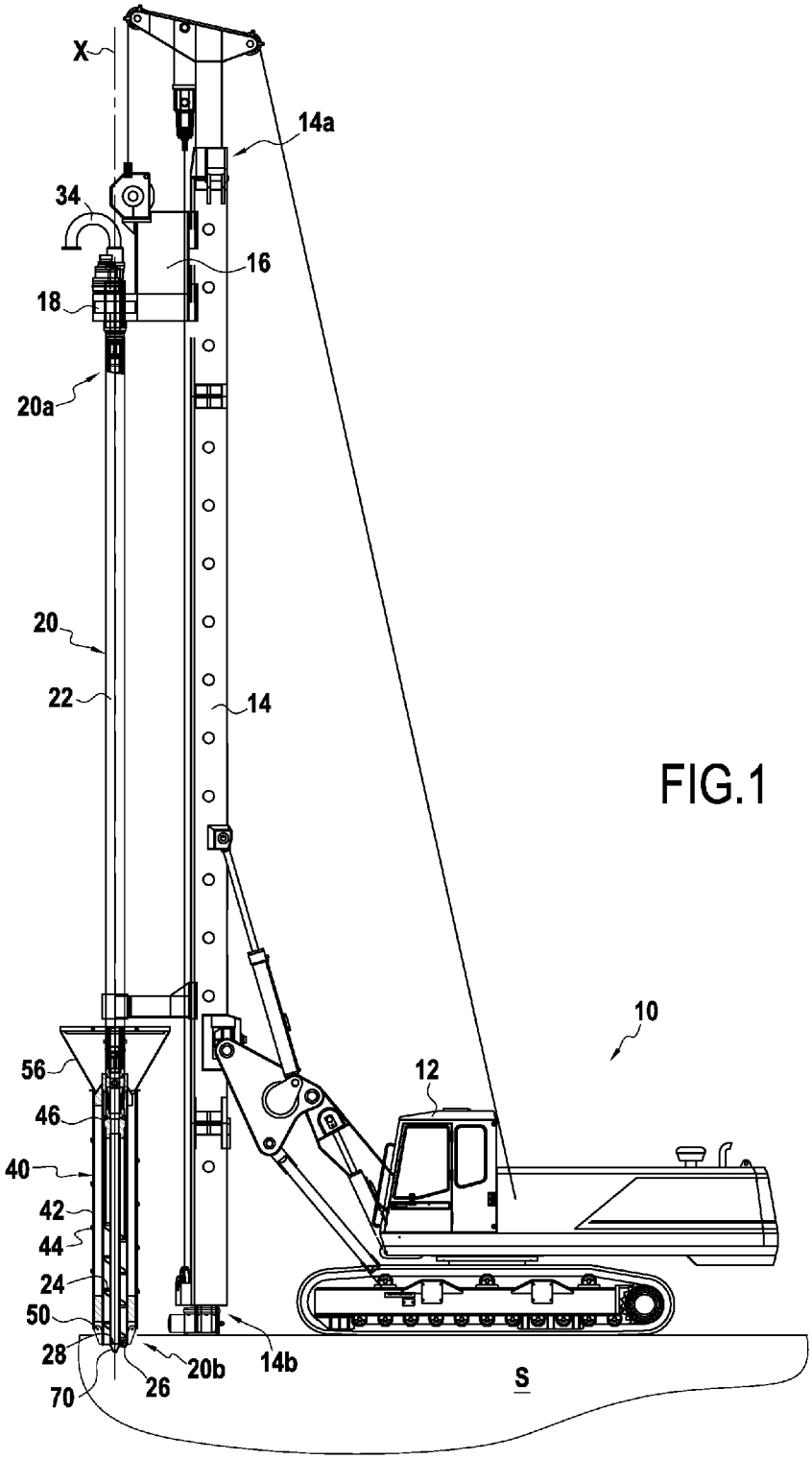
FIG. 1 shows a machine for making columns in the ground, in a first embodiment of the invention.

FIG. 1 shows a machine 10 for making columns in ground S in a first embodiment of the invention.

The drilling machine 10 comprises a carrier 12 having a drilling mast 14 mounted thereon, generally in hinged manner. The carrier 12 may also have other pieces of equipment mounted thereon such as the control desk for the drilling machine 10.

A movable carriage 16 is mounted to slide along the mast 14. This sliding carriage 16 can be moved along the mast 14 by means that are themselves known and not described in detail herein.

A rotary drive device (first rotary drive device) in the form of a rotation head 18 is mounted on the carriage 16. The rotation head 18 is connected to the top end of a perforation tool 20 that it is adapted to set into rotation in order to perforate the ground S.

Below, a bottom end 20*b* of the perforation tool 20 is defined as its end facing the ground when the tool is in position ready to drill, and a top end 20*a* of said tool is defined as facing towards the sky when the tool is in the same position.

The perforation tool 20 comprises a hollow central core 22 extending along a longitudinal axis X parallel to the mast 14 and defining a longitudinal pipe, together with a cutter tool 26 at its bottom end, for cutting the ground S.

In the particular example shown, the perforation tool 20 is an auger, and more particularly a displacement auger, suitable for penetrating into the ground without extracting spoil. Nevertheless, this example is not limiting.

The operation of a displacement auger is itself well known, and is therefore not described in detail below.

Figure 3A:
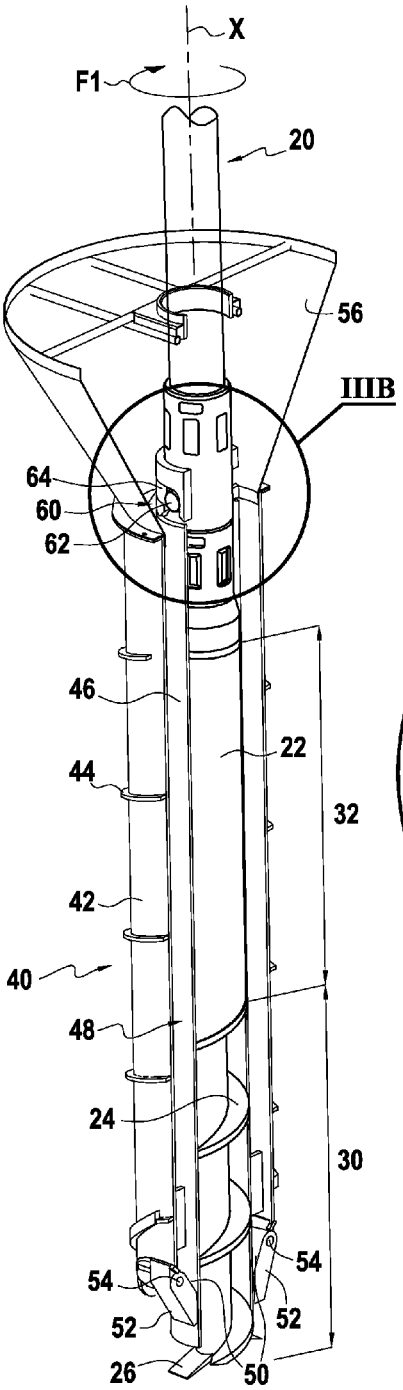
FIGS. 3A and 3B show the system for interconnecting the perforation tool and the body.

It is merely recalled here that the perforation tool 20 has a helical blade 24 of substantially constant diameter extending over a bottom portion 30 of the central core 22 (see in particular FIG. 3A). In the example, the bottom portion 30 is surmounted by a top portion 32 of larger diameter for the purpose, during drilling, of displacing laterally the soil that has been cut by the helical blade 24.

The top end 20*a* of the perforation tool 20 is connected to feed means 34 for feeding a first building material, specifically concrete.

The bottom end 20*b* of the perforation tool 20 is provided with an orifice 28 for injecting the first building material into the ground S.

According to the invention, the machine 10 also has a body 40 that extends around the perforation tool 20 and that forms a tank in this example.

Figure 2:
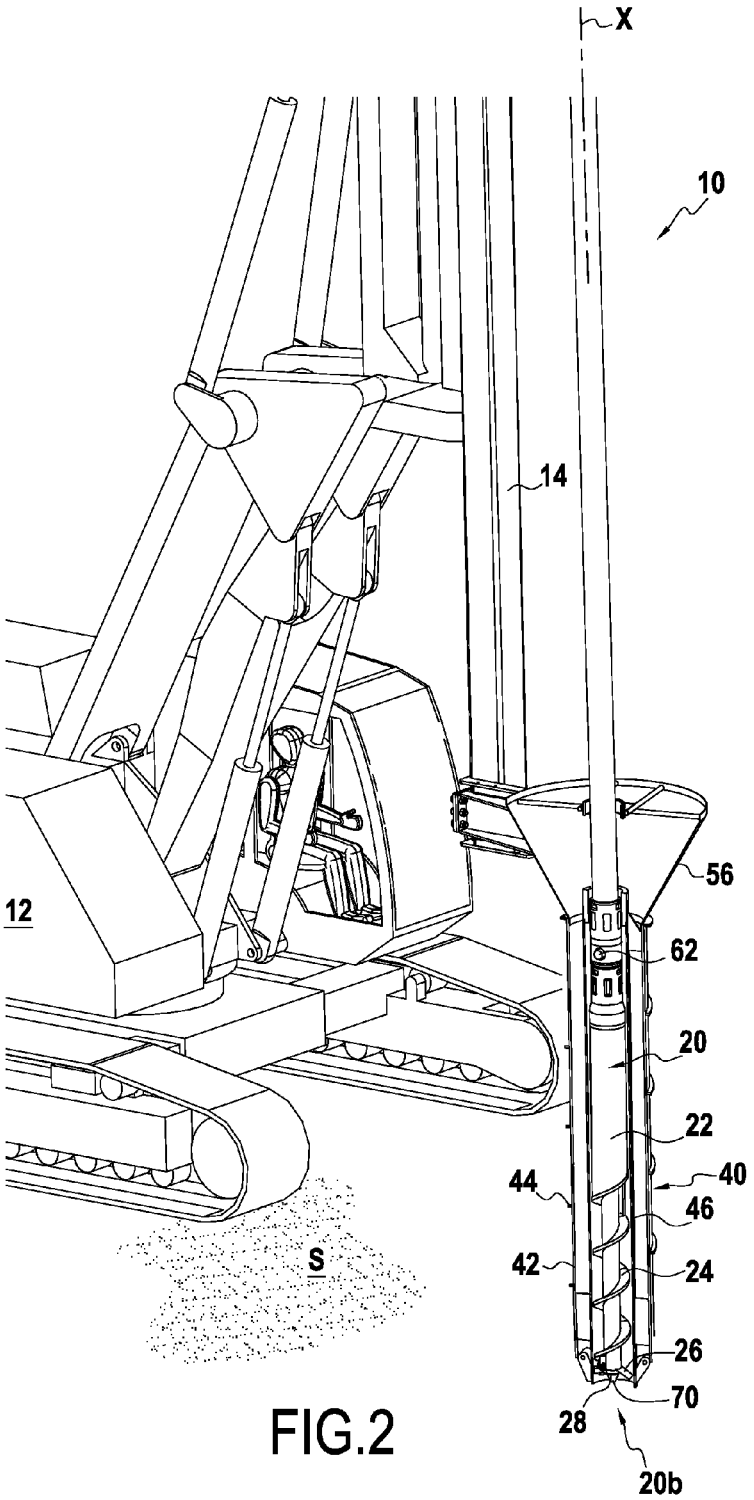
FIG. 2 is a partially cut away perspective view of the bottom portion of the FIG. 1 machine.
Figure 3B:
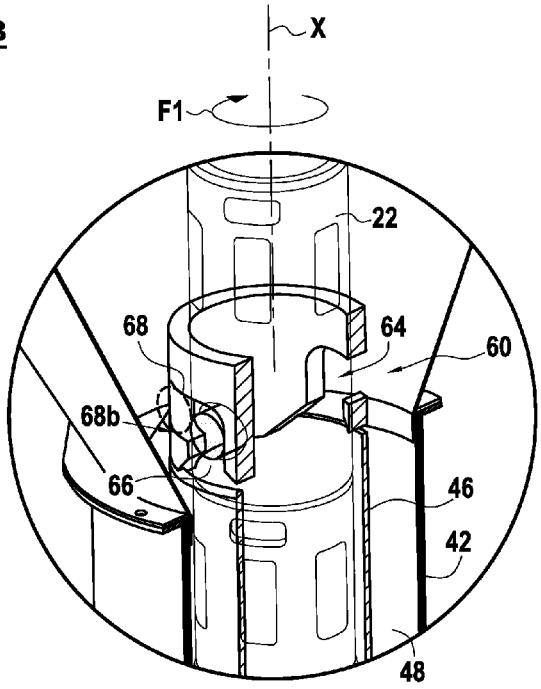

As can be seen more particularly in FIGS. 2 and 3, the body 40 comprises a cylindrical outer shell 42 for coming into contact with the ground S and extending around the perforation tool 20.

The outer shell 42 of the body 40 is coaxial around the perforation tool 20, and on its outside face it carries a helical blade 44 in order to facilitate penetration of the body 40 into the ground on rotating.

The diameter of the outer shell 42 is generally at least 1.2 times greater than the diameter of the perforation tool 20.

By way of example, the diameter of the outer shell is 600 millimeters (mm) for a perforation tool having a diameter equal to 420 mm.

In the example, the body 40 is for receiving a second building material, and for this purpose it has an inside wall 46 in the form of a tube arranged inside the outer shell 42 and co-operating therewith to define an annular space 48 that is to receive said second material, specifically ballast. It can be understood that the annular space 48 extends radially between the inner tube 46 and the outer shell 42.

At its bottom end, the body 40 has at least one opening 50 (specifically two openings) for discharging the second building material.

In the example, the bottom end of the body also has at least one flap 52 (specifically two flaps) of a dimension suitable for covering the opening 50 of the body. In other words, each flap 52 is for closing an opening 50.

Specifically, each flap 52 is mounted to pivot about an axis 54 mounted on the outer shell 42. In the example, each flap is configured to close while the body 40 is moving downwards as a result of the flap bearing against the ground, and to open under gravity while moving upwards under the effect of thrust from the second material that is discharged through the corresponding opening 50.

In the example shown, the top end of the outer shell 42 is also secured to a funnel-forming portion 56 that makes it easier to fill the body 40 with the second building material.

In the example shown, the body 40 is moved exclusively by means of the perforation tool 20. The body 40 is not mounted on the mast 14 of the machine 10. It is independent of the mast 14.

The machine 10 has a coupling system 60 for coupling the body 40 to the perforation tool 20, both in rotation and in translation. These coupling means 60 operate in a manner that can be understood better with reference to FIGS. 3A and 3B, and specifically they comprise at least one first element fastened to or forming an integral portion of the perforation tool 20 and at least one second element fastened to or forming an integral portion of the body 40, said elements being adapted to co-operate so as to form a bayonet connection.

In the example, the first element is a stud 62 formed at the periphery of the central core 22. More particularly, the perforation tool 20 presents two diametrically opposite studs in this example.

The second element is an L-shaped slot 64 formed in a top portion of the body 40, having a first branch 66 that is open at its bottom end and that extends in the longitudinal direction, and another branch 68 forming a housing extending orthogonally relative to the first branch 66, in the direction F1 of rotation of the body 40. More particularly, in this example the body has two diametrically opposite slots 64.

It should be observed that the coupling means 60 could also have some other form. In particular, in a variant the at least one first element could be a slot and the at least one second element could be a stud.

In the example shown, it can readily be understood that in a first position (a coupled position), in which each stud 62 comes into abutment against the end wall 68*c* of a housing 68 (the stud shown in dashed lines in FIG. 3B), the perforation tool 20 drives the body 40 to move together therewith when it is set into rotation about its axis X in the direction F1.

Simultaneously, when the perforation tool moves downstream, i.e. towards the ground, each stud 62 comes into abutment against the upstream wall 68*b* of the housing 68. Consequently, the perforation tool 20 drives the body 40 in its movement in translation.

Conversely, in a second position (decoupled position) in which each stud 62 is extracted from the housing 68 (stud drawn in continuous lines in FIG. 3B), the central core 22 is entirely free to slide through the body 40 and is free to rotate relative to the body 40. As described in greater detail below, it can then be lowered into the ground S down to the depth P2 that is desired for the column, and then raised up to the body while discharging the first building material through its orifice 28.

In the example, it should be observed that the slots 64 are formed in a top portion of the body 40 that is configured in such a manner that, regardless of the angular position of the central core 20 relative to the body 40, the studs 62 come into abutment against said portion when they are in their highest position. It can thus be understood that the perforation tool 20 always entrains the body 40 in its upward movement along the axis X, the studs coming into abutment against the body 40.

The top portion in question in this example is a top portion of the inner tube 46, of smaller inside diameter.

It should be observed that in that above-mentioned upward movement, it is desired to stop concrete being discharged once the bottom end 20*b* of the tool has come into contact with the bottom end 40*b* of the body 40.

Figure 4:
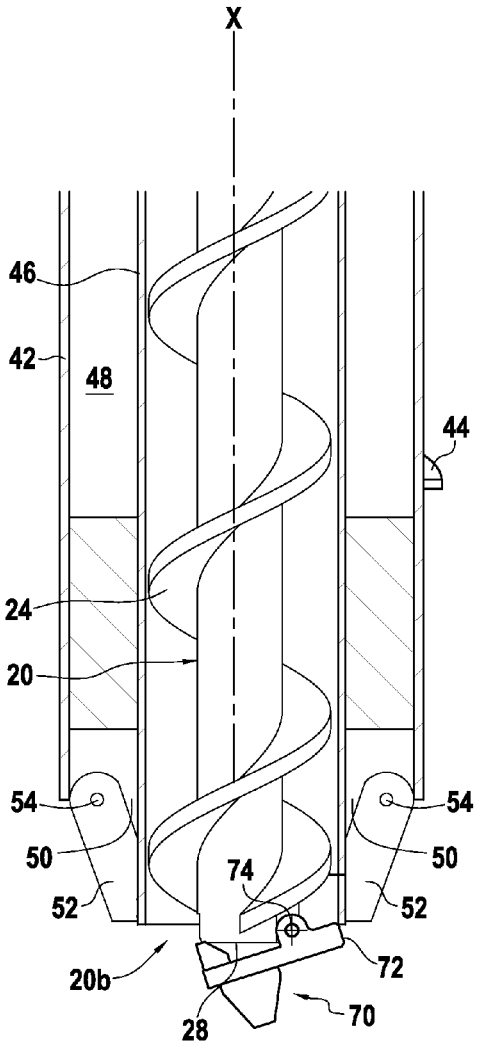
FIGS. 4 and 5 show the operating principle of the shutter arranged at the bottom end of the perforation tool.
Figure 5:
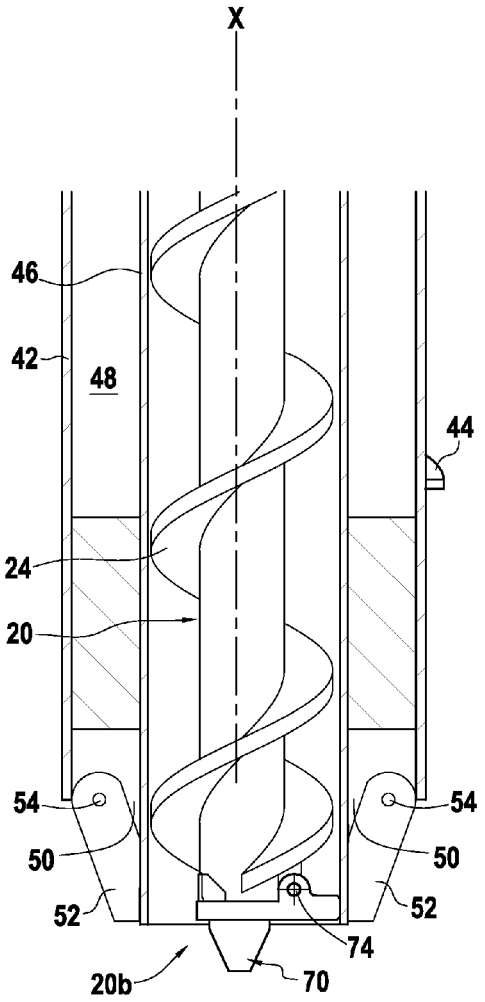
Figure 6A:
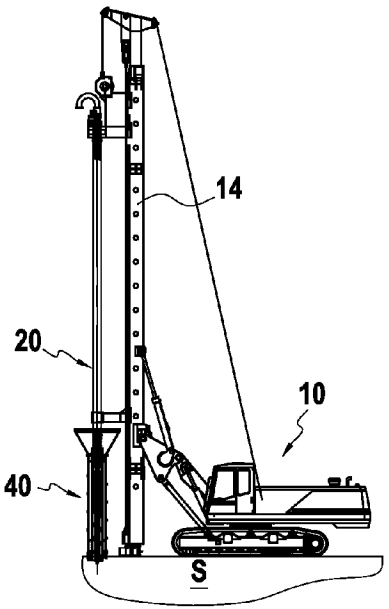
FIGS. 6(*a*) to 6(*e*) show the various steps of the method of making a column with the FIG. 1 machine.
Figure 6B:
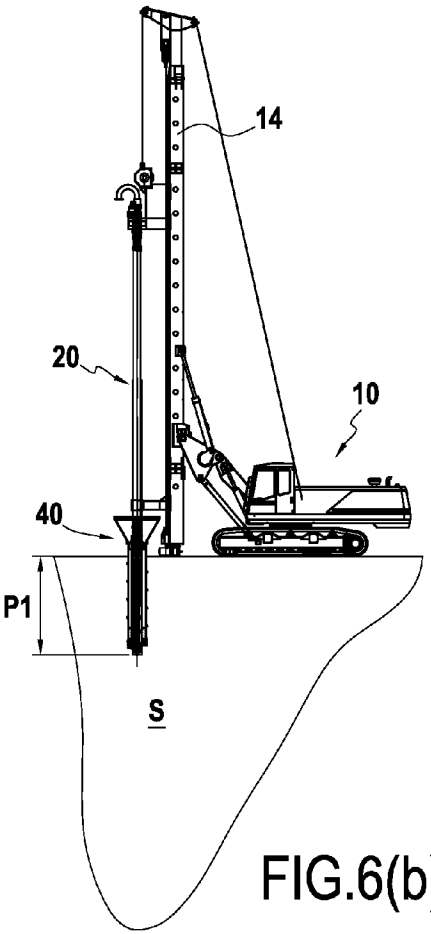
Figure 6C:
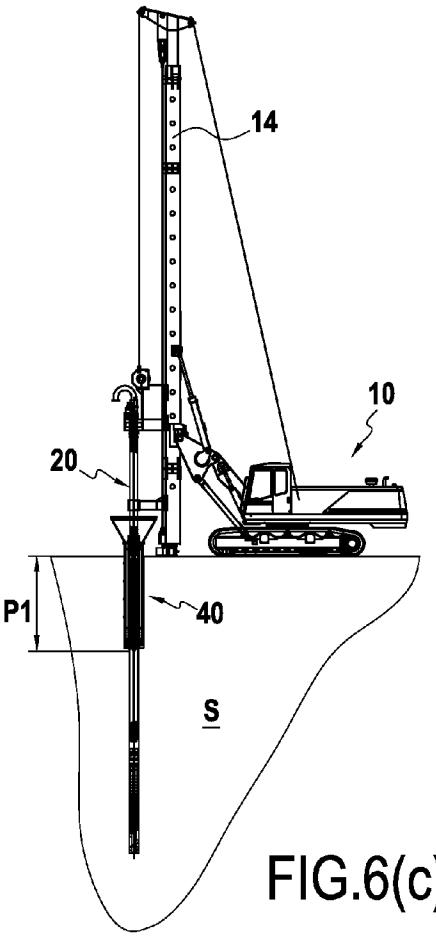
Figure 6D:
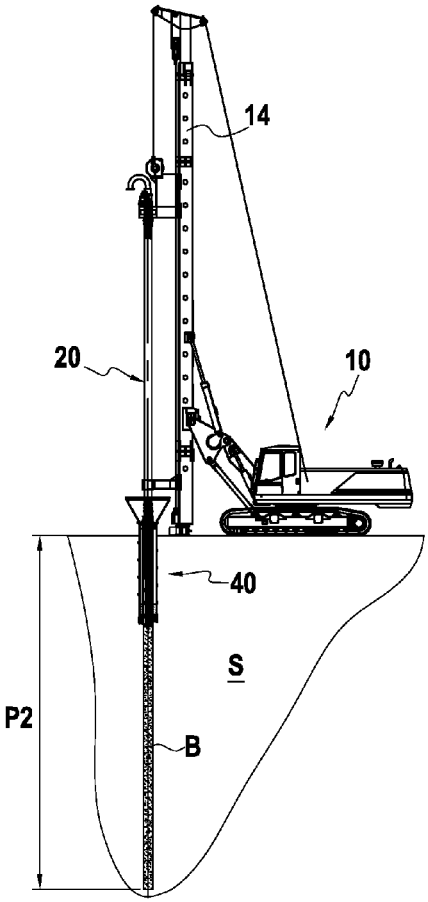
Figure 6E:
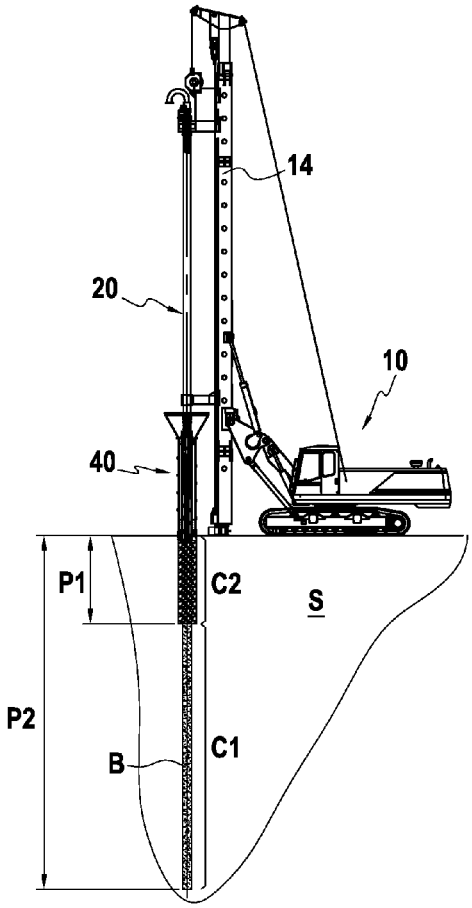

For this purpose, and as shown in greater detail in FIGS. 4 and 5, a shutter 70 is pivotally mounted at the bottom end 20*b* of the perforation tool 20 to pivot about a pivot axis 74. More precisely, the shutter 70 presents an abutment surface 72 that is suitable, when the perforation tool 20 is raised to the proximity of the body 40, for co-operating with the bottom end of the inner tube 46 by a camming mechanism so as to cause the shutter 70 to pivot about the axis 74, thereby causing the shutter to shut the orifice 28. This stops the flow of concrete.

With reference to FIGS. 6(*a*) to 6(*e*), there follows a description of an example of a method of making a hybrid column C in ground S by means of the invention using the above-described machine 10.

In step (a), the carriage 16 is positioned at the top of the mast 14 so that the body 40 and the perforation tool 20 that are coupled together are located above the ground.

In step (b), the rotation head 18 is actuated and the carriage 16 is moved towards the bottom end of the mast 14 so that the body 40 and the perforation tool 20 penetrate into the ground S to a first predetermined depth P1. The body 40 and the perforation tool 20 are driven together in rotation in the direction of arrow F1.

In step (c), the perforation tool 20 is turned in the opposite direction through a few degrees, so as to extract the lug 62 from the housing 68 and bring it into register with the second branch 66 of the slot 64. The body 40 remains in place, in particular it does not turn, as a result of the friction of the ground S against its outer shell 42. The body 40 and the perforation tool 20 are then in their decoupled position.

The carriage 16 is then moved along the mast 14 towards its bottom end 14*b*, causing the perforation tool 40 to move down into the ground S to a second depth P2 that is deeper than the first depth P1.

In step (d), the carriage 16 is returned towards the top end 14*a* of the mast 14 so as to raise the perforation tool 20. While it is moving upwards, the shutter 70 is open and concrete B is introduced into the ground through the orifice 28, thereby forming a bottom column portion C1. In this step, the body 40 is held in the ground at the first depth P1 and it does not move. As mentioned above, the shutter 70 closes when the perforation tool 20 is raised up to said first depth P1. At that instant, the perforation tool 20 is turned in the direction of rotation through a few degrees so that the stud 62 penetrates into the slot 64 and ends up being received in the housing 68. The perforation tool 20 and the body 40 are then constrained to move together in rotation and in translation.

In step (e), the perforation tool 20 is raised while being driven in rotation. As the body 40 moves upwards, ballast M is discharged into the ground through the opening 50 of the body, above the bottom column portion C1, so as to form a top column portion C2.

It should be observed that in the example shown, the entire volume occupied by the body 40 is filled with the second building material, but that it is equally possible to fill only a portion thereof. Under such circumstances, it can be understood that the top surface of the second column is situated below the surface of the ground.

It should also be observed that the top portion of the column may be constituted by a plurality of different materials. For example, it may comprise a first segment made of ballast and a second segment, above the first, made of a material of poorer quality.

Figures 7, 8:
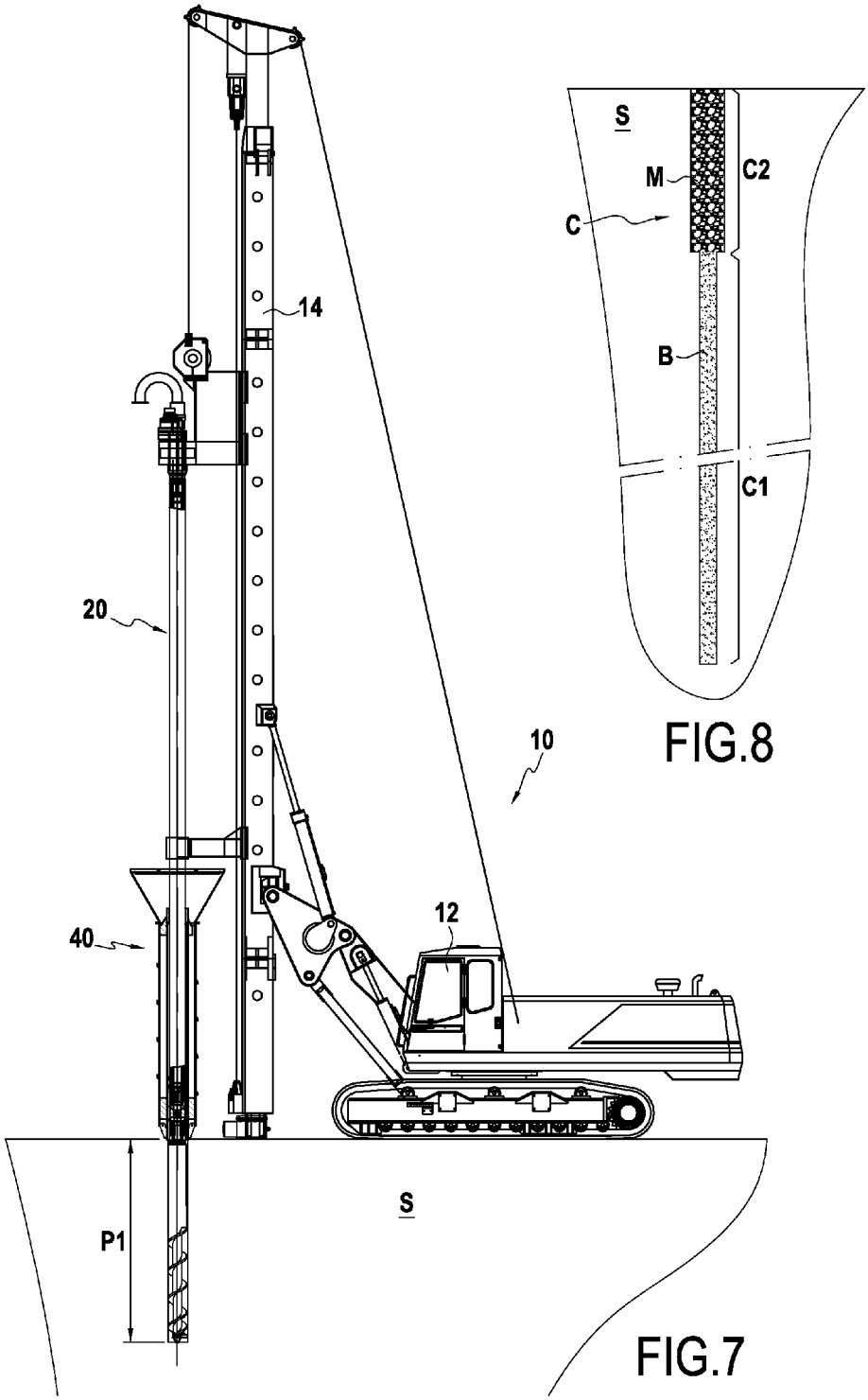
FIG. 7 shows a variant of the method described with reference to FIG. 6.
FIG. 8 shows a hybrid column made using the method of the present invention.

In the example, at the end of step (e), a hybrid column C is obtained as shown in FIG. 8 that is constituted by a bottom portion C1 made of concrete B, and a top portion C2 made of ballast M.

The machine 10 of the invention also makes it possible to make columns out of a single material. For this purpose, during step (d), the perforation tool 20 is raised by pumping the second building material, specifically concrete, into the ground S so as to form the bottom portion C1 of the column. The concrete may be conveyed via the longitudinal pipe and discharged via the orifice 28 situated at the bottom end 20*b* of the perforation tool 20.

Thereafter, during step (e), the assembly constituted by the body 40 and the perforation tool 20 is raised completely, while continuing to pump concrete into the ground S so as to form the top portion C2 of the column. In this implementation, it can be understood that the top and bottom portions are both made of concrete, which is introduced into the ground in a single stage. Once more, the concrete may be conveyed by the longitudinal pipe and then discharged by the orifice 28. In this particular utilization, it can be understood that the body 40 need not have a discharge opening 50. Under such circumstances, provision may be made for the shutter 70 to remain open so as to allow concrete to be pumped during this stage of upward movement. For this purpose, the bottom end of the perforation tool projects a little beyond the bottom end of the body so as to avoid closing the shutter.

In a particular provision, the inner wall 46 could also be omitted. In another implementation and on the contrary, provision may be made for the concrete to be conveyed via the inside of the body 40 and discharged through the opening 50 provided at the bottom end of the body.

In some situations, the ground to be perforated is very compact and makes it difficult for the body 40 to penetrate into the ground S, in particular when the body 40 is of large diameter and when the first depth P1 is deep.

Under such circumstances, a solution using the invention may consist in performing a prior step of decompressing the ground S before causing the coupled-together assembly of the body 40 and the perforation tool 20 to penetrate therein as described with reference to step (a) above, and then to continue by performing steps (b) to (e).

This prior decompression step, shown in FIG. 7, consists in lowering the perforation tool 20 into the ground on its own, generally at least as far as the first depth P1, i.e. lowering the perforation tool 20 while it is separate from the body 40 (leaving the body resting on the surface of the ground), and then in raising the tool and in coupling together the body 40 and the perforation tool 20.

Figure 9A:
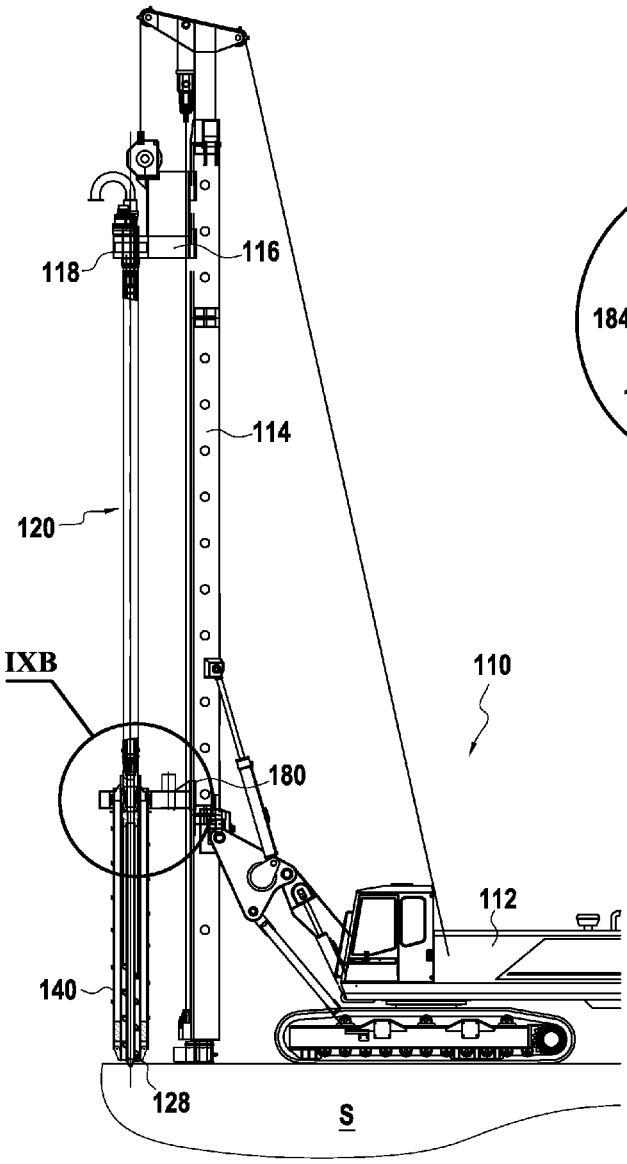
FIG. 9A shows a machine for making columns in ground in a second embodiment of the invention.
Figure 9B:
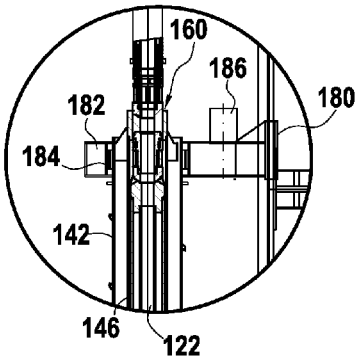
FIG. 9B shows in greater detail the second system for driving the body in rotation, as shown in FIG. 9A.
Figure 10A:
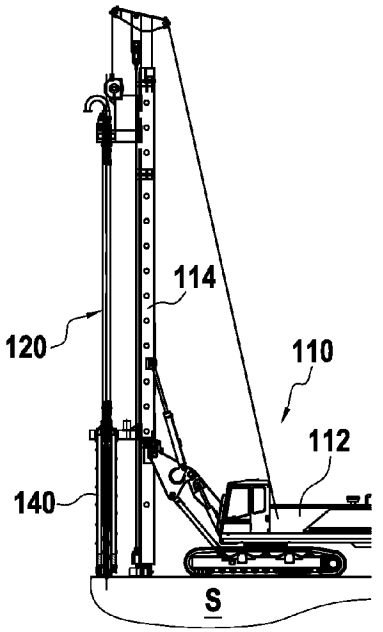
FIGS. 10(*a*) to 10(*e*) show the various steps of the method of making a column with the FIG. 9A machine.
Figure 10B:
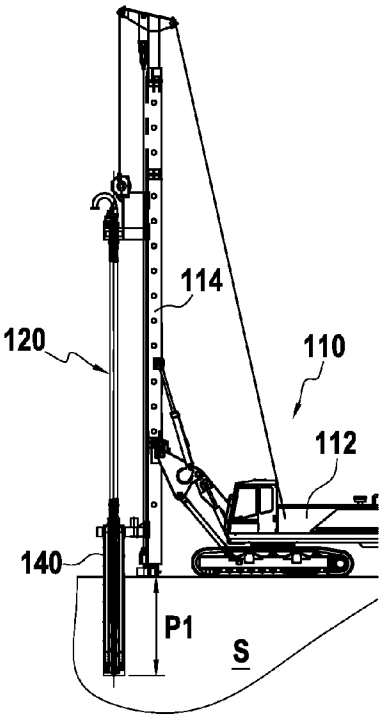
Figure 10C:
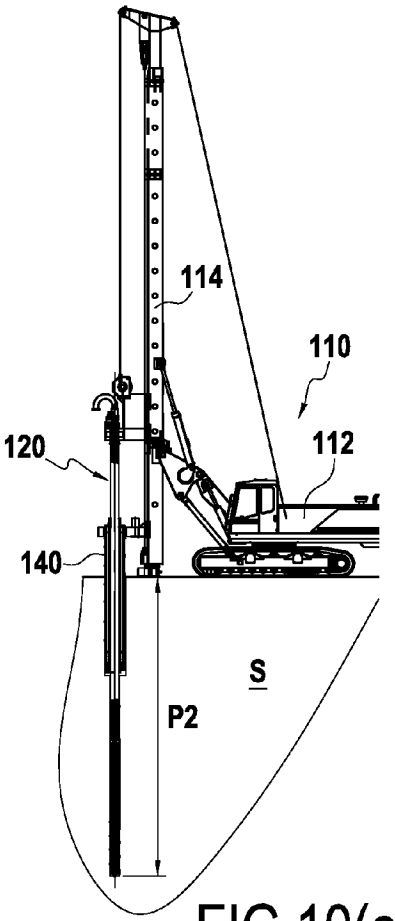
Figure 10D:
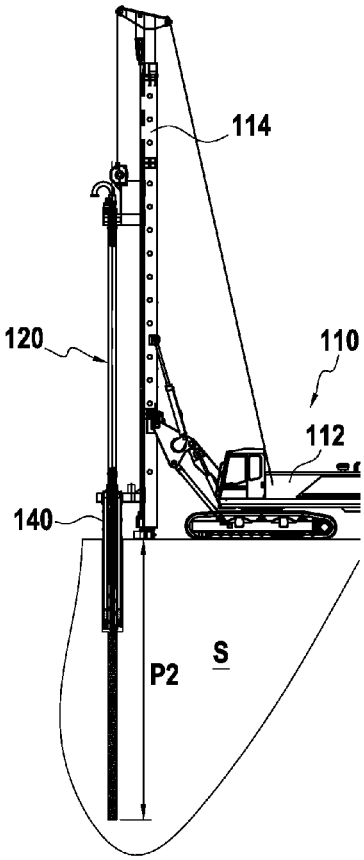
Figure 10E:
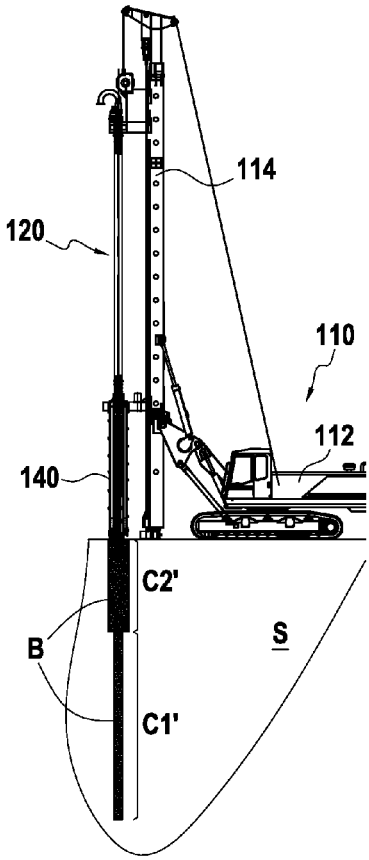

FIGS. 9A and 9B show a machine 110 in a second embodiment of the invention that is particularly adapted to making two-diameter piles.

It should be observed that elements that are identical or similar to elements of the machine 10 in the first embodiment are given the same numerical references plus 100.

This machine 110 has a longitudinal mast 114 mounted on a carrier 112, and a carriage 116 that slidable along the mast 114, similar to the carriage 16 in the first embodiment, the carriage having a first rotary drive system 118 mounted thereon for driving a perforation tool 120 in rotation.

The machine 110 also has a body 140 similar to the body 40 of the first embodiment. Nevertheless, it should be observed that in this example the body is longer than when making a structure with a low top level. In this example, the body presents a length of about 6 meters (m).

A coupling system 160 between the body 140 and the perforation tool 120 is also provided, which system is similar to that of the first embodiment.

The machine 110 in this second embodiment differs from the preceding machine in that it also has a second carriage 180 mounted to slide along the mast 114, below the first carriage 116.

In the example shown, this second carriage 180 carries a second rotary drive system 182, which is coupled to the body 140.

In this example, the second rotary drive system 182 comprises a ring 184 connected to the outer shell 142 of the body 140, e.g. by being welded to its outside surface. The ring is itself connected to a motor 186 for driving it in rotation.

With the body 140 being driven in rotation by the perforation tool 120, the carriage 180 is free to move in translation along the mast 114 while being entrained by the body 140. No specific drive means are provided for moving the second carriage 180 on the machine 110.

It can be understood that the second rotary drive system 182 is for acting in addition to the perforation tool 120, which serves to drive it in rotation when coupled to the body 140. The rotary torque applied to the body 140 during the stage of drilling into the ground is thus increased, thereby making drilling easier, in particular when the body 140 is of large diameter, when the first depth P1 is particularly deep, and/or when the ground is particularly compact.

With reference to FIGS. 10(*a*) to 10(*e*), there follows a description of the method of the invention for making a two-diameter pile using the second embodiment machine 110 shown in FIGS. 9A and 9B.

In step (a), the first carriage 116 is located at the top end of the mast 114. The perforation tool 120 and the body 140 are in a high position, above the ground S, and they are coupled together.

In step (b), the perforation tool 120 is driven in rotation and the carriage 116 is lowered towards the bottom end of the mast 114, entraining the assembly constituted by the coupled-together perforation tool 120 and the body 140, and also entraining the second carriage 180 that is secured to the body 140. At the same time, the second rotary head 182 drives the body 140 in rotation in the same direction as the perforation tool 120.

The assembly constituted by the body 140 and the perforation tool 120 is lowered to the first depth P1.

In step (c), the perforation tool 120 and the body 140 are uncoupled and the perforation tool 120 is lowered into the ground S down to the second depth P2, deeper than the first depth P1.

In step (d), the perforation tool 120 is raised up to the depth P1, while injecting concrete B into the ground, thereby forming a bottom portion of a pile, and then the perforation tool 120 and the body 140 are coupled together (both in rotation and in translation).

In step (e), the assembly formed by the perforation tool 120 and the body 140 is raised finally while continuing to inject concrete B via the orifice 128 of the perforation tool, so as to form the top portion of the pile.

Optionally, in an additional step (f), and before the concrete has set, it is possible to introduce at least one reinforcing cage 190 into the first and/or second column portion in order to reinforce the pile. By way of example, it is possible to place a first reinforcement cage presenting a first diameter in the first portion of the column, and a second reinforcement cage of greater diameter in the second portion of the column. Under such circumstances, the second reinforcement cage may optionally surround a top portion of the first reinforcement cage. It is also possible to place a single reinforcement cage of varying diameter in both the first and second column portions.

Figure 11:
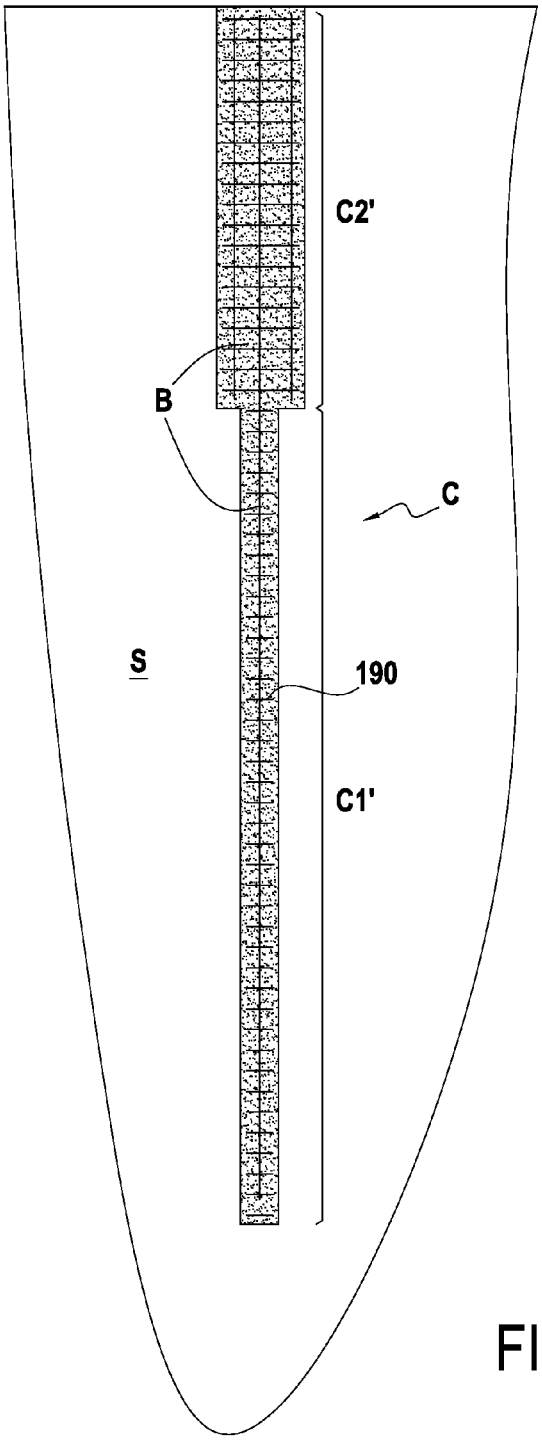
FIG. 11 is a view of a two-diameter pile made using the method of the present invention.

Once the concrete has set, a two-diameter concrete pile C' is finally obtained as shown in FIG. 11, which pile presents a bottom portion C1' and a top portion C2' of greater diameter, both portions being reinforced by metal reinforcement.

It can be understood that in this second embodiment, the openings 50 and the flaps 52 may be omitted from the body. Under such circumstances, provision is also made for the shutter 70 to remain open by allowing the bottom end of the perforation tool to project a little outside the body.

Nevertheless, it should be observed that the machine in this second embodiment may be used in the same manner for making hybrid columns, and in particular for making concrete structures of low top level, which structures are covered in temporary filling material, as described with reference to the first embodiment.

The invention claimed is:

1. A machine for making columns in ground, the machine comprising:

a carrier having a mast extending along a longitudinal direction;

a movable carriage mounted to slide along the mast;

a ground perforation tool extending along a longitudinal axis parallel to said longitudinal direction and secured to said movable carriage, presenting a top end connected to building material feed means, and a bottom end provided with an orifice for injecting building material;

a rotary drive system for driving the ground perforation tool in rotation;

a body extending around the ground perforation tool so that the ground perforation tool is suitable for sliding through said body; and a coupling system for coupling together the body and the ground perforation tool, configured in such a manner that, in at least one configuration, moving the ground perforation tool in rotation entrains rotation of the body and moving the ground perforation tool in translation entrains the body in translation, and wherein the coupling system is a bayonet system.

2. The machine according to claim 1, wherein the body is not attached to the mast.

3. The machine according to claim 1, further including a second rotary drive system mounted on the mast, and configured to drive the body in rotation.

4. The machine according to claim 1, wherein the ground perforation tool comprises a central core extending along the longitudinal axis and surrounded by a helical blade.

5. The machine according to claim 1, wherein the body comprises a cylindrical outer shell for coming into contact with the ground and extending around the ground perforation tool.

6. The machine according to claim 5, wherein the diameter of the outer shell is at least 1.2 times greater than the diameter of the ground perforation tool.

7. The machine according to claim 5, wherein the outer shell carries a helical blade on its outside face.

8. The machine according to claim 5, wherein the body further includes an inner wall arranged between the outer shell and the ground perforation tool.

9. The machine according to claim 1, wherein the body is for receiving a second building material, and is provided at its bottom end with an opening for discharging said second building material.

10. The machine according to claim 1, wherein the ground perforation tool further includes a shutter suitable for shutting the orifice.

11. The machine according to claim 10, wherein said shutter is arranged in such a manner that it shuts the orifice when the bottom end of the ground perforation tool comes into contact with the bottom end of the body.

12. A method of making a column in ground using the machine according to claim 1, the method comprising the following steps:

a) rotating the ground perforation tool and the body while they are coupled together in rotation and in translation to cause them to penetrate into the ground to a first predetermined depth;

b) uncoupling the body and the ground perforation tool;

c) lowering the perforation tool to a second predetermined depth deeper than the first depth;

d) raising the ground perforation tool from said second predetermined depth while injecting a first building material into the ground through the orifice situated at the bottom end of the ground perforation tool; and e) raising both the ground perforation tool and the body.

13. The method according to claim 12, wherein, during step e), at least one second building material is discharged into the ground while raising the ground perforation tool and the body.

14. The method according to claim 13, wherein during step e), said at least one second building material is discharged via the orifice of the ground perforation tool.

15. The method according to claim 13, wherein the body is for receiving the at least one second building material and is provided, at its bottom end, with an opening for discharging said second building material, and during step e), the second building material is discharged via said opening.

16. The method according to claim 12, including, prior to step a), a step a0) in which the ground perforation tool is lowered for a first time into the ground at least down to the first predetermined depth and then raised.

17. The method according to claim 12, wherein the machine includes a second rotary drive system mounted on the mast and configured to drive the body in rotation, and during step a), the body is driven in rotation by the first rotary drive system and by the second drive system.

18. The machine according to claim 6, wherein the diameter of the outer shell is at least 1.5 times greater than the diameter of the ground perforation tool.

* * * * *